United States Patent [19]

Simms

[11] 4,012,629

[45] Mar. 15, 1977

[54] FLASHLIGHT RING

[76] Inventor: Winston Simms, 128 Belmont Ave., Long Branch, N.J. 07740

[22] Filed: Nov. 13, 1975

[21] Appl. No.: 631,644

[52] U.S. Cl. ..... 240/6.4 W; 63/1 R; 240/10.6 R; 240/59

[51] Int. Cl.[2] ..... F21V 33/00

[58] Field of Search ..... 240/6.4 W, 59, 6.4 K, 240/6.4 R, 10.6 R, 10.66, 6.46; 63/15, 15.5, 15.7, 1 R; 224/28 C, 28 F

[56] References Cited

UNITED STATES PATENTS

| | | | |
|---|---|---|---|
| 2,176,789 | 10/1939 | Capitani | 240/59 |
| 3,392,276 | 7/1968 | Roman | 240/6.46 |
| 3,465,543 | 9/1969 | Baker | 63/15.5 |
| 3,790,775 | 2/1974 | Rosenblatt | 240/6.4 W |
| 3,804,307 | 4/1974 | Johnston | 240/6.4 K |

*Primary Examiner*—John Gonzales
*Attorney, Agent, or Firm*—Jack D. Slobod

[57] ABSTRACT

A flashlight ring includes a hollow toroidal finger encircling member formed in four sectors. A front sector carries a lamp socket while a rear sector carries a switch. Left and right side sectors are hinged to the rear sector for swinging movement to allow arcuately elongated batteries to be loaded therein.

1 Claim, 4 Drawing Figures

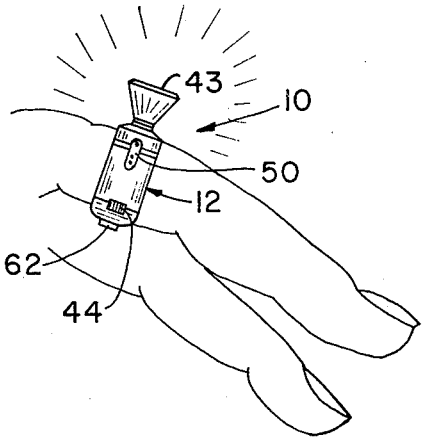
FIG. 1
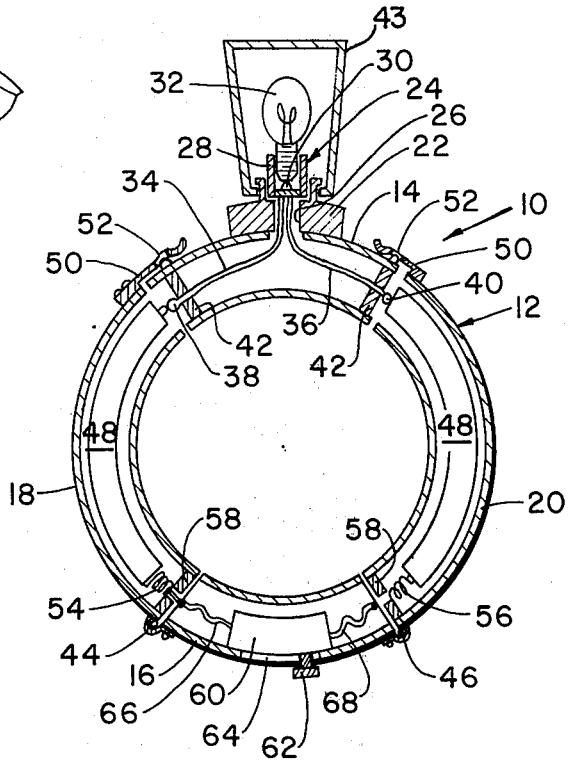
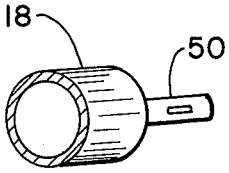
FIG. 4
FIG. 2
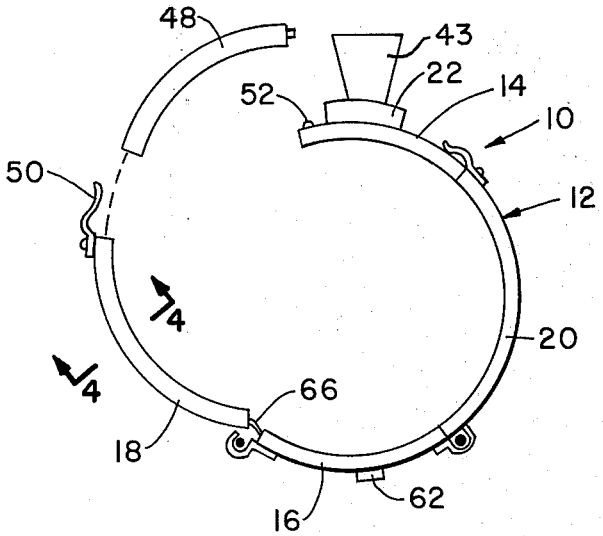
FIG. 3

FLASHLIGHT RING

FIELD OF THE INVENTION

The present invention relates generally to flashlight devices adapted to be worn on the finger as a ring. In its particular aspects, the present invention relates to a flashlight ring configured for holding a battery within a hollow finger encircling member.

BACKGROUND OF THE INVENTION

Flashlight rings have heretofore been proposed which carry a battery externally of the ring in a pendant relationship. Illustrative is U.S. Pat. No. 2,516,180 to Brown. Such rings are bulky and the exposed battery detracts from the appearance of the ring.

OBJECTS OF THE INVENTION

It is an object of the present invention to provide a flashlight ring having a battery holder formed within the hollow interior of a finger encircling member.

It is a further object of the present invention to provide a hollow finger encircling member formed of a plurality of sectors which are configured to enable a battery to be loaded into the interior of the finger encircling member.

SUMMARY OF THE INVENTION

Briefly, the aforementioned and other objects of the present invention are satisfied by providing a flashlight finger ring which includes a generally toroidal hollow finger encircling member carrying a lamp socket on a front portion of the member and a switch at a rear portion of the member, battery holders are formed within left and right portions of the finger encircling member. The battery holders, switch and lamp socket are coupled in a series circuit by conductor means within the finger encircling member.

To enable arcuately elongated batteries to be loaded in the left and right portions, the portions are hinged to the rear portion for swinging movement. The left and right portions also carry clasps for engagement with the front portion to constrain the left, right, front and rear sections to form the toroidal finger encircling member.

The flashlight ring of the present invention thus has a neat appearance because batteries are located within the hollow interior of the finger encircling member.

Other objects, features and advantages of the present invention will become apparent upon perusal of the following detailed description of the preferred embodiment thereof when taken in conjunction with the appended drawing wherein:

FIG. 1 is a pictorial view of the flashlight finger ring of the present invention as worn;

FIG. 2 is a cross-sectional plan view of the flashlight ring in FIG. 1;

FIG. 3 is a plan view of the flashlight ring in FIG. 1 with its parts positioned for loading or unloading a battery therein; and FIG. 4 is a cross-sectional view taken through the lines 4—4 in FIG. 3.

DETAILED DESCRIPTION

Referring to FIGS. 1 through 4 of the drawing, the flashlight finger ring of the present invention is generally indicated by the reference numeral 10. Ring 10 comprises a hollow generally toroidal metal finger encircling member 12 which is formed in four separate arcuate sectors. The four sectors comprise a front sector 14, a rear sector 16 and left and right side sectors 18 and 20.

Front sector 14, at its center, carries a dielectric support 22 on its outer side which in turn carries a radially projecting lamp socket 24 in a central bore 26. Lamp socket 24 has terminals 28 and 30 for contacting a flashlight bulb 32 threadably received therein. A pair of leads 34 and 36 are connected at one end respectively to terminals 28 and 30. Leads 34 and 36 run through an opening in the wall of sector 14 in line with bore 26 and run within sector 14 in opposite directions respectively to contacts 38 and 40 carried in dielectric bushings 42 at the opposite ends of the sector. A translucent jewel-like cover 43 is provided engaged on support 22 for encasing lamp 32.

The left and right sectors 18 and 20 are respectively pivotly mounted at their rear ends to opposite ends of rear sector 16 via hinges 44 and 46. The hinges 44 and 46 allow swinging movement of the side sectors for loading arcuately elongated batteries 48 therein. The front ends of sectors 18 and 20 carry resilient apertured clasp elements 50 for engaging knobs 52 on the front sector 14.

The batteries 48 are essentially identical to AA size 1.5 volt cylindrical flashlight batteries except they are manufactured specially to be elongated along a curve to enable the batteries to fit inside the sectors 18 and 20. The rear ends of sectors 18 and 20 respectively carry contact springs 54 and 56 in dielectric bushings 58. One battery is engaged at its positive terminal by contact 38 and at its negative terminal by spring 54 while the other battery is engaged at its positive terminal by spring 56 and at its negative terminal by contact 40.

The rear sector 16 carries a switch 60 within its interior. Switch 60 has a sliding actuating element 62 which passes through an elongated slot 64 in the wall of the rear sector at its center. Flexible leads 66 and 68 respectively connect contact springs 54 and 56 to the terminals of switch 60.

It should thus be apparent that the interior of sectors 18 and 20 comprise battery holders which are in series with each other and with switch 60 and lamp socket 24. With the ring 10 worn on the usual ring finger, the actuating element 62 is conveniently manipulated with the thumb of the same hand for turning on lamp 32 when desired.

While the preferred embodiment of the present invention has been described in specific detail, it should be understood that numerous modifications, additions and omissions in the details thereof are possible within the intended spirit and scope of the invention claimed herein.

What is claimed is:

1. A flashlight finger ring device adapted to receive first and second elongated arcuate batteries and a lamp; said device comprising: a generally torodoidal hollow finger encircling member formed of arcuate front, rear, left and right sectors; said left and right sectors being hingedly joined at their rear ends to opposite ends of said rear sector for swinging movement; clasp means carried by the front ends of said left and right sectors for respectively engaging left and right ends of said front sector; said right and left sectors being adapted to respectively receive within their interiors said first and second batteries, first left and right contact means respectively carried by the rear ends of said left and right sectors for respectively electrically engaging rear ends of said first and second batteries; second left and right contact means respectively carried by the left and right ends of said front sector for respectively electrically engaging front ends of said first and second batteries; a lamp socket carried by said front sector for receiving said lamp; first conductor means within said front sector electrically connecting said lamp socket between said second left and right contact means; a switch means carried by said rear sector; and second conductor means electrically connecting said switch means between said first left and right contact means.

* * * * *